US011222572B2

(12) United States Patent
Jeong et al.

(10) Patent No.: US 11,222,572 B2
(45) **Date of Patent: *Jan. 11, 2022**

(54) DRIVING APPARATUS FOR DOUBLE RATE DRIVING DISPLAY

(71) Applicant: Silicon Works Co., Ltd., Daejeon (KR)

(72) Inventors: Hyun Woo Jeong, Daejeon (KR); Young Uk Chang, Daejeon (KR); Ju Ho Lee, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/109,562

(22) Filed: Dec. 2, 2020

(65) Prior Publication Data

US 2021/0183292 A1 Jun. 17, 2021

(30) Foreign Application Priority Data

Dec. 11, 2019 (KR) ..... 10-2019-0164260

(51) Int. Cl.
*G09G 3/20* (2006.01)

(52) U.S. Cl.
CPC ..... *G09G 3/20* (2013.01); *G09G 2310/0275* (2013.01); *G09G 2310/0294* (2013.01); *G09G 2310/0297* (2013.01); *G09G 2330/021* (2013.01)

(58) Field of Classification Search
CPC ..... G09G 3/20; G09G 3/3275–3291; G09G 3/3685–3692; G09G 2310/0264–0297; G09G 2330/021; G09G 2330/23
See application file for complete search history.

(56) References Cited

U.S. PATENT DOCUMENTS

2006/0232542 A1 10/2006 Nishi et al.
2012/0146963 A1* 6/2012 Kim ..... G09G 3/3688 345/204

FOREIGN PATENT DOCUMENTS

KR 2004-0017157 A 2/2004
KR 2010-0137836 A 12/2010
KR 2012-0065175 A 6/2012

* cited by examiner

*Primary Examiner* — Gene W Lee
(74) *Attorney, Agent, or Firm* — Polsinelli PC

(57) ABSTRACT

Disclosed is a driving apparatus for a display, which drives pixels using a double rate driving (DRD) method. The driving apparatus includes a first latch circuit storing first pixel data, a second latch circuit storing second pixel data, a first selection circuit selecting one of the first pixel data and the second pixel data and outputting selection data, and a second selection circuit selecting one of the selection data of a pair of adjacent first selection units and outputting source data.

15 Claims, 8 Drawing Sheets

| | | | | | | |
|---|---|---|---|---|---|---|
| LAT2_D | DU | R0 | R1 | B1 | R2 | R3 |
| LAT1_D | DU | G0 | B0 | G1 | G2 | B2 |

| SEL1 | SEL2 | DAC1 | DAC2 | DAC3 | DAC4 | DAC5 | DAC6 |
|---|---|---|---|---|---|---|---|
| L | H | DU | R0 | R1 | B1 | R2 | R3 |
| H | H | DU | G0 | B0 | G1 | G2 | B2 |
| L | L | R0 | R1 | B1 | R2 | R3 | |
| H | L | G0 | B0 | G1 | G2 | B2 | |

| | | | | | | |
|---|---|---|---|---|---|---|
| LAT2_D | R0 | B0 | G1 | R2 | B2 | G3 |
| LAT1_D | G0 | R1 | B1 | G2 | R3 | B3 |

| SEL1 | SEL2 | OUT1 | OUT2 | OUT3 | OUT4 | OUT5 | OUT6 |
|---|---|---|---|---|---|---|---|
| L | L | R0 | B0 | G1 | R2 | B2 | G3 |
| H | L | G0 | R1 | B1 | G2 | R3 | B3 |

DRIVING APPARATUS FOR DOUBLE RATE DRIVING DISPLAY

BACKGROUND

1. Technical Field

The present disclosure relates to a driving apparatus for a display, and more particularly, to a driving apparatus for a display, which drives pixels using a double rate driving (hereinafter referred to as "DRD") method.

2. Related Art

Recently, a technology for driving a screen using the DRD method is applied to a display system.

In order to drive the screen using the DRD method, a display panel has a rendering structure supplied with data through a data line in a time division manner. Illustratively, the display panel may have a DRD structure in which a pair of pixels is disposed right and left with a data line interposed therebetween and the pair of pixels shares the data line disposed between the pixels.

The display system using the DRD method can reduce the number of data lines of a display panel and implement high-quality horizontal resolution using a small number of data lines.

In general, a display system includes a plurality of drivers in order to drive a display panel. The drivers are configured to drive source signals corresponding to data lines in a horizontal region assigned thereto.

If the display panel having the DRD structure is adopted, the number of drivers necessary to configure a display system is reduced in accordance with a small number of data lines.

A timing controller needs to determine the sort order of display data in order to render the display data in the display panel. Furthermore, the driver needs to be designed to restore the display data in a data packet and to distribute the restored display data to the data lines according to the sort order in a time division manner.

In particular, the drivers need to be designed to have a latch structure for distributing the display data in a time division manner. The latch structure of the drivers needs to be designed to reduce the occurrence of EMI and the number of parts.

The display system may represent screens having various patterns, such as a still image or a moving image. The driver requires a high frequency operation and increases power consumption, as the driver implements high resolution.

If a still image that maintains the same pattern is displayed, the driver may repeatedly output source signals corresponding to horizontal data having the same pattern repeated in a horizontal cycle unit.

In this case, the driver needs to be designed to reduce power consumption by performing a low power operation of deactivating an unnecessary operation.

Furthermore, if a screen is displayed in the display panel having the DRD structure, the driver needs to be designed to have a latch structure capable of distributing display data to data lines in a time division manner using the DRD method, while guaranteeing a low power operation.

SUMMARY

Various embodiments are directed to providing a driving apparatus for a display, which has a latch structure for distributing display data in a time division manner using the DRD method.

Various embodiments are directed to providing a driving apparatus for a display, which can distribute display data using the DRD method, and reduce the occurrence of EMI and the number of parts.

Various embodiments are directed to providing a driving apparatus for a display, for distributing display data using the DRD method and processing horizontal data having the same pattern, such as a still image, in a low power mode.

Various embodiments are directed to providing a driving apparatus for a display, which has a latch structure for distributing display data in a time division manner in accordance with a display panel having a DRD structure in which one data line is shared by two pixels on the left and two pixels on the right.

Various embodiments are directed to providing a driving apparatus for a display, which has a latch structure for distributing display data in a time division manner in accordance with a display panel having a DRD structure in which one data line is shared by a pair of left and right pixels.

Various embodiments are directed to providing a low power mode to a driving apparatus for a display, having a latch structure for distributing display data in a time division manner using a DRD method and reducing power consumption of the driving apparatus through the low power mode.

In an embodiment, a driving apparatus for a display includes a first latch circuit including first latches storing first pixel data, a second latch circuit including second latches corresponding to the first latches, respectively, and storing second pixel data, wherein the second pixel data is updated through the first latch corresponding to the second latch, a first selection circuit including first selection units each selecting one of the first pixel data and the second pixel data and outputting the selection data, and a second selection circuit including second selection units each selecting one of the selection data of a pair of adjacent first selection units and outputting source data.

In an embodiment, a driving apparatus for a display includes a first latch storing first pixel data in a first horizontal cycle, a second latch storing second pixel data in a second horizontal cycle faster than the first horizontal cycle by one cycle, wherein the second pixel data is updated into the second latch through the first latch, a first selection unit selecting one of the first pixel data and the second pixel data and outputting first selection data, a third latch storing third pixel data in the first horizontal cycle, a fourth latch storing fourth pixel data in the second horizontal cycle, wherein the fourth pixel data is updated into the fourth latch through the third latch, a second selection unit selecting one of the third pixel data and the fourth pixel data and outputting second selection data, and a third selection unit selecting the first selection data or the second selection data and outputting source data.

DETAILED DESCRIPTION

Figure 1:
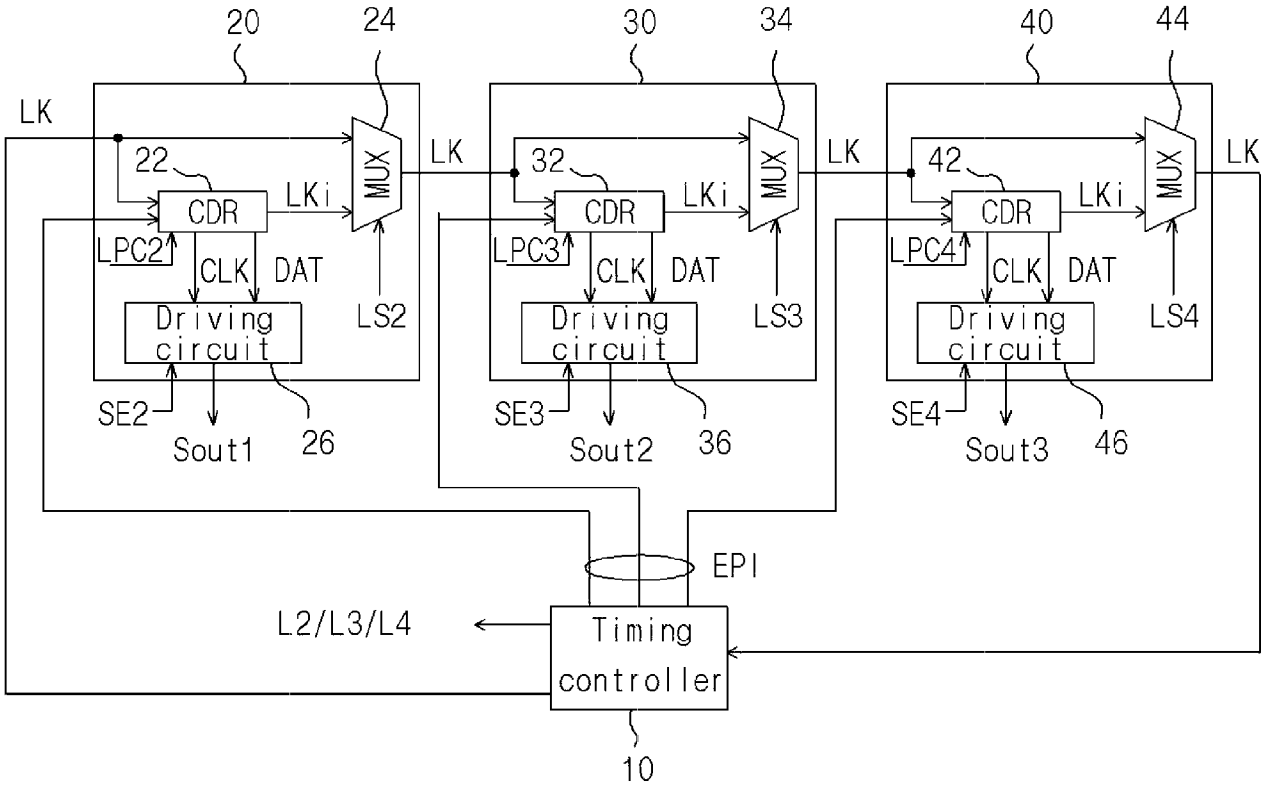
FIG. 1 is a block diagram illustrating a system for a display to which a driving apparatus according an embodiment of the present disclosure is applied.

A driving apparatus for a display according to an embodiment of the present disclosure may be applied to a system for a display as illustrated in FIG. 1. Furthermore, states driven in a display panel by the driving apparatus according to an embodiment of the present disclosure may be described with reference to FIG. 2.

The driving apparatus implemented by an embodiment of the present disclosure may be understood as being a driver, and will be hereinafter described as a driver.

Figure 2:
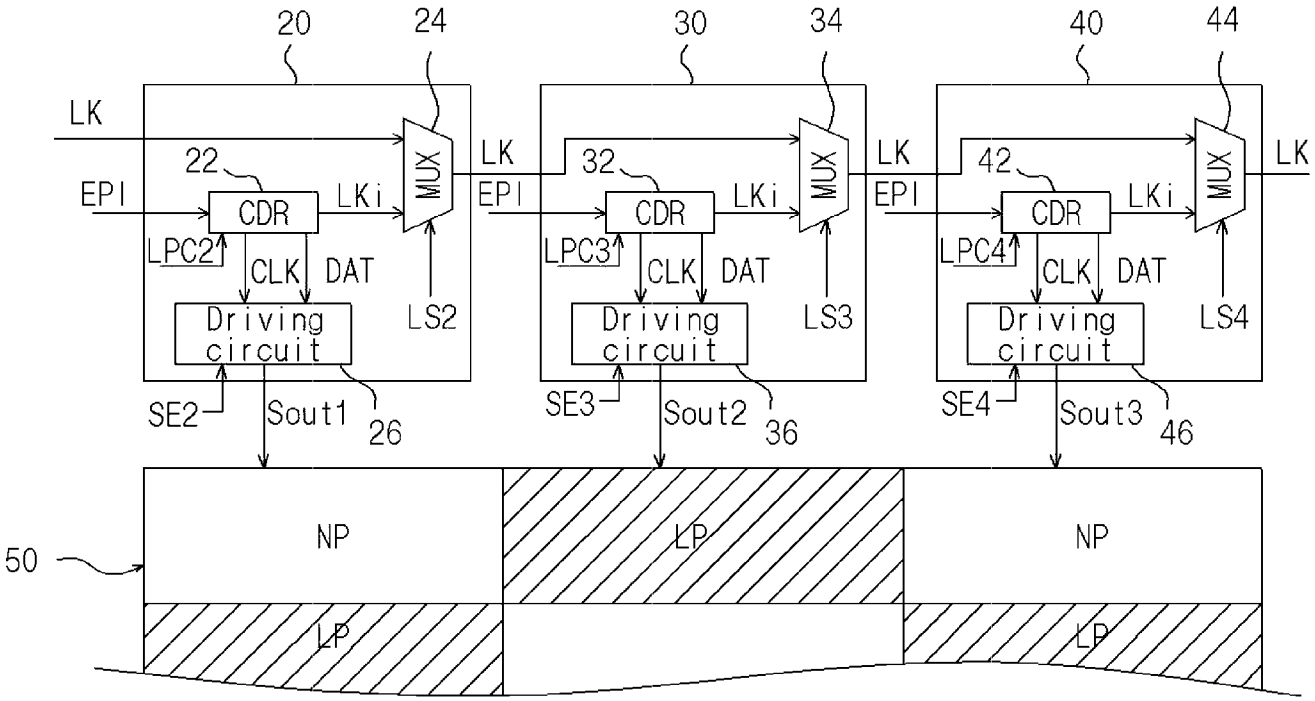
FIG. 2 is a block diagram illustrating a configuration between the driving apparatus and a display panel in order to describe a low power mode.

Referring to FIGS. 1 and 2, the system for displaying a screen includes a timing controller 10 and a plurality of drivers 20, 30, and 40. A display panel 50 is configured to receive source signals Sout1 to Sout3 from the plurality of drivers 20, 30, and 40 and display a screen.

Each of the plurality of drivers 20, 30, and 40 implemented by an embodiment of the present disclosure may operate in a normal mode and a low power mode.

In the normal mode, each of the drivers 20, 30, and 40 restores display data and a clock, and displays a screen having a change in the pattern like a moving image. In the low power mode, the state of each of the drivers 20, 30, and 40 is set as a low power state in which some operations of restoring display data and a clock are stopped, and each of the drivers 20, 30, and 40 displays a screen in which the same pattern is repeated in a horizontal cycle unit like a still image.

Each of the drivers 20, 30, and 40 may display a screen in the normal mode with respect to the entire one frame, or may display a screen in the low power mode with respect to the entire one frame, or may display a screen in the normal mode with respect to some consecutive horizontal lines in one frame, and may display a screen in the low power mode with respect to the remaining consecutive horizontal lines.

As described above, the drivers 20, 30, and 40 may be independently driven in the normal mode or the low power mode, and each may operate to identically display a region of the display panel 50, which is responsible for each driver, in a black or white or specific color in the low power mode.

In the display panel 50 of FIG. 2, an NP region means a region represented in the normal mode. An LP region means a region represented in the low power mode.

An embodiment of the present disclosure is more specifically described with reference to FIGS. 1 and 2.

The timing controller 10 configures and outputs a data packet EPI including control data and horizontal data in each horizontal cycle, and includes low power information for enabling the low power mode in the control data in a horizontal cycle in which the low power mode is initiated.

The timing controller 10 is configured to output a lock signal LK and control signals L2, L3, and L4 through signal lines different from the signal line of the data packet EPI.

The timing controller 10 is configured to provide the lock signal LK to the driver 20 and to receive, from the driver 40, the lock signal LK sequentially passing through the drivers 20, 30, and 40.

Furthermore, the timing controller 10 is configured to provide the drivers 20, 30, and 40 with the control signals L2, L3, and L4, respectively. Each of the control signals L2, L3, and L4 includes a mode control signal, selection signals, and a lock control signal.

Specifically, the control signal L2 includes a mode control signal LPC2, a selection signal SE2, and a lock control signal LS2. The control signal L3 includes a mode control signal LPC3, a selection signal SE3, and a lock control signal LS3. Furthermore, the control signal L4 includes a mode control signal LPC4, a selection signal SE4, and a lock control signal LS4. Among them, each of the selection signals SE2, SE3, and SE4 includes selection signals SEL1 and SEL2 described later with reference to FIG. 4.

Each of the mode control signals LPC2 to LPC4 is output in a way to shift to an enable level at timing at which the low power mode wakes up, in order to notify a corresponding driver of timing at which the low power mode is terminated.

The selection signals SE2 to SE4 are output in the low power mode, and are for controlling the distribution of display data latched in the drivers 20, 30, and 40, respectively. Each of the selection signals SEL1 and SEL2 of each of the selection signals SE2 to SE4 described later with reference to FIG. 4 may have a periodically varying value for determining a location where specific pixel data is rendered in the display panel 50.

Each of the lock control signals LS2 to LS4 is for controlling a driver, operating in the low power mode, to bypass the lock signal LK, and maintains an enable level in the low power mode.

The drivers 20, 30, and 40 are configured to output source signals Sout1 to Sout3 to pre-assigned regions of the display panel 50, respectively.

Each of the drivers 20, 30, and 40 receives the data packet EPI, restores control data, display data and a clock of the data packet EPI in the normal mode, and outputs a source signal corresponding to the display data using the clock.

Furthermore, each of the drivers 20, 30, and 40 restores and latches first horizontal data of the data packet EPI in a first horizontal cycle, and second horizontal data of the data packet EPI in a second horizontal cycle that is faster than the first horizontal cycle by one cycle, in the low power mode, stops the restoration of control data, display data, and a clock, and then outputs a source signal corresponding to the latched first horizontal data and second horizontal data.

Each of the drivers 20, 30, and 40 may enter the low power mode based on the low power information of the control data.

In the normal mode and the low power mode, the driver 20 outputs the source signal Sout1, the driver 30 outputs the source signal Sout2, and the driver 40 outputs the source signal Sout3.

The display panel 50 receives the corresponding source signals Sout1 to Sout3 for each region, and displays a screen.

Furthermore, the drivers 20, 30, and 40 sequentially transmit the lock signal LK provided by the timing controller 10. The driver 40 in the last order is configured to feed the lock signal LK back to the timing controller 10.

In the normal mode, each of the drivers 20, 30, and 40 is configured to generate an internal lock signal LKi by updating the lock signal LK, received from the timing controller 10 or a driver in previous order, with information on a clock restored within each driver, and to transmit one of the lock signal LK and the internal lock signal LKi to a driver in next order.

A driver that belongs to the drivers 20, 30, and 40 and that enters the low power mode is configured to bypass the lock signal LK, received from a driver in previous order and to provide the lock signal LK to a driver in next order because the driver does not restore a clock signal.

The driver 20 includes a clock data restoration (CDR) circuit 22, a multiplexer (MUX) 24, and a driving circuit 26. The driver 30 includes a CDR circuit 32, a multiplexer 34, and a driving circuit 36. The driver 40 includes a CDR circuit 42, a multiplexer 44, and a driving circuit 46.

Each of the drivers 20, 30, and 40 may be understood as having the same structure in which the CDR circuit, the driving circuit, and the multiplexer are combined. Among the signals used for the drivers 20, 30, and 40, the internal lock signal LKi, the clock CLK, and display data DAT are indicated as the same reference numerals in the drivers 20, 30, and 40. The mode control signal, the selection signals, the lock control signal, and the source signal are indicated as different reference numerals in the drivers 20, 30, and 40.

Hereinafter, a configuration and operation of the driver 30 are described. Configurations and operations of the drivers 20 and 40 may be understood with reference to the configuration and operation of the driver 30, and thus a redundant description thereof is omitted.

First, the CDR circuit 32 receives the data packet EPI, the mode control signal LPC3, and the lock signal LK received from the driver 20 in previous order.

In the normal mode, the CDR circuit 32 restores control data, the display data DAT, and the clock CLK from the data packet EPI in a horizontal cycle unit, and provides the display data DAT and the clock CLK to the driving circuit 36.

Furthermore, the CDR circuit 32 generates information indicating whether the clock CLK internally restored in the horizontal cycle unit is normal, generates the internal lock signal LKi by updating the lock signal LK, that is, the lock signal LK received from the driver 20 in the previous order, with the information indicating whether the clock CLK is normal, and outputs the generated internal lock signal LKi.

The CDR circuit 32 determines whether low power information for enabling the low power mode is included in the control data of the restored display data DAT in a horizontal cycle unit.

The restored display data DAT includes a control data period that includes control information in each horizontal line period corresponding to each horizontal cycle, a horizontal data period including horizontal data, and a clock training period including clock information. The control information included in the control data period may be configured to represent low power information using some bits. In this case, the low power information may be configured with 1 bit or 2 bits.

If the low power information for enabling the low power mode is included in the control data, the CDR circuit 32 recognizes entry into the low power mode, restores horizontal data and a clock in a horizontal cycle including the low power information, enters the low power mode, and then stops the restoration of the control data, the display data DAT, and the clock CLK.

The CDR circuit 32 may recognize the entry into the low power mode by computing pieces of low power information in two horizontal cycles, that is, a first horizontal cycle and a second horizontal cycle to be described later.

The structure of the data packet EPI and the low power information are more specifically described with reference to FIG. 3.

The data packet EPI includes frame periods divided by a vertical blank (VB). One frame period includes frame data for displaying one screen (or frame) in the display panel 50.

Figure 3:
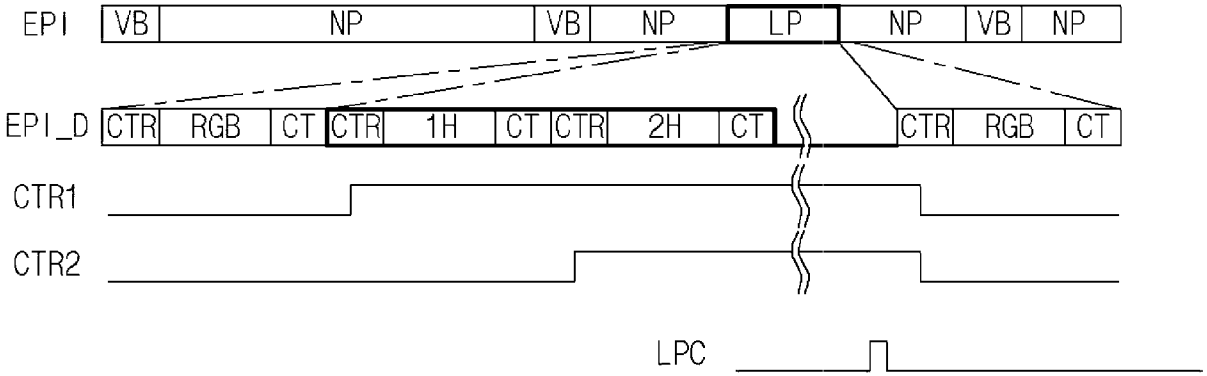
FIG. 3 is a waveform diagram describing a data packet corresponding to the low power mode.

In FIG. 3, the first frame period includes frame data for forming an NP region represented in the normal mode. In accordance with the frame data, all of the drivers 20, 30, and 40 operate in the normal mode and output the source signals Sout1 to Sout3 for representing the NP region. In contrast, the second frame period includes frame data for forming an NP region represented in the normal mode, an LP region represented in the low power mode, and an NP region represented in the normal mode. In accordance with the frame data, the drivers 20 and 40 operate in the normal mode and output the source signals Sout1 and Sout3 for representing the NP region. The driver 30 operates in the low power mode and outputs the source signal Sout2 for representing the LP region. The second frame period may be understood with reference to the display panel 50 of FIG. 2.

One frame includes a plurality of horizontal lines determined depending on resolution of the display panel 50. Accordingly, one frame period includes a plurality of horizontal line periods. Data included in each of the horizontal line periods may be referred to as horizontal line data.

Each of the horizontal line periods includes a control data period CTR including control data, a horizontal data period including horizontal data, and a clock training period CT including clock information. That is, the horizontal line data may be understood as including control data, horizontal data, and clock information.

In FIG. 3, a horizontal data period included in the horizontal line period of an NP region may be indicated as RGB.

A driver that receives horizontal line data for representing an NP region operates in the normal mode. That is, the driver restore control data, display data DAT, and a clock CLK in a horizontal line period unit, and outputs a source signal corresponding to the display data DAT using the control data and the clock CLK.

In FIG. 3, a horizontal data period included in the horizontal line period of an LP region may be indicated as 1H and 2H.

A driver that receives horizontal line data for representing an LP region operates in the low power mode. That is, the driver recognizes entry into the low power mode based on the control data of the horizontal line data, latches the horizontal data of the horizontal line data at timing at which the driver enters the low power mode, stops the restoration of control data, display data DAT, and a clock CLK, and then outputs a source signal corresponding to the latched horizontal data.

An embodiment of the present disclosure illustrates that a screen is driven using the DRD method. For the driving of a screen using the DRD method, two horizontal data may be rendered in one data line. To this end, when entering the low power mode, a driver implemented by an embodiment of the present disclosure latches horizontal data included in a horizontal data period 1H and horizontal data period 2H corresponding to two horizontal cycles, and outputs a source signal in which the latched horizontal data in the two horizontal cycles are rendered.

The low power information for low power mode entry may be included in control information included in the control data period CTR of each horizontal line. The control information may include one or two bits for indicating the low power information. Accordingly, the low power mode may be enabled based on a value of the low power information of the control information.

Illustratively, the driver internally generates a control signal CTR1 that maintains an enable level during the low power mode based on low power information included in the horizontal data period 1H and a control signal CTR2 that maintains an enable level during the low power mode based on low power information in the horizontal data period 2H, and recognizes entry into the low power mode by combining the control signals CTR1 and CTR2.

Accordingly, the CDR circuit 32 restores horizontal data included in the horizontal data period 1H of a horizontal cycle in which the control signal CTR1 is enabled and horizontal data included in the horizontal data period 2H of a horizontal cycle in which the control signal CTR2 is enabled, and then stops the restoration of the display data DAT and the clock CLK during the low power mode.

The CDR circuit 32 cannot receive information for returning from the low power mode to the normal mode through the data packet EPI because the CDR circuit 32 does not restore control data, display data, and clock information during the low power mode.

Accordingly, the CDR circuit 32 may return from the low power mode to the normal mode in response to the mode control signal LPC3 provided by the timing controller 10.

The CDR circuit 32 determines wake-up timing for returning from the low power mode to the normal mode in response to the mode control signal LPC3 (corresponding to LPC in FIG. 3), and operates in the normal mode after the wake-up timing, thus resuming the restoration of the display data DAT and the clock CLK.

Furthermore, the multiplexer 34 receives the lock signal LK from the driver 20 and the internal lock signal LKi from the CDR circuit 32, selects one of the lock signal LK and the internal lock signal LKi, and provides, as the lock signal LK, the selected signal to the driver 40 in next order. In order to select and output the lock signal LK to be provided to the driver 40, the multiplexer 34 receives the lock control signal LS3 from the timing controller 10.

The lock control signal LS3 is for distinguishing between the normal mode and the low power mode, and is provided to have an enable level in the low power mode.

In the normal mode in which the lock control signal LS3 has a disable level, the multiplexer 34 selects the internal lock signal LKi of the CDR circuit 32, outputs the selected internal lock signal LKi as the lock signal LK. In the low power mode in which the lock control signal LS3 has an enable level, the multiplexer 34 bypasses the lock signal LK and provides the lock signal LK to the driver 40.

In the low power mode, the CDR circuit 32 does not need to determine whether a restored clock is normal, because it stops the restoration of the control data, the display data DAT, and the clock CLK. Accordingly, in the low power mode, the multiplexer 34 bypasses the lock signal LK received from the driver 20 and provides the lock signal LK to the driver 40.

The driving circuit 36 is configured to receive the display data DAT and the clock CLK from the CDR circuit 32, receive the selection signal SE3 from the timing controller 10, and output the source signal Sout2 to the display panel 50. The selection signal SE3 includes the selection signals SEL1 and SEL2 to be described later with reference to FIG. 4.

In the normal mode, the driving circuit 36 is configured to output the source signal Sout2 corresponding to the display data DAT using the clock CLK.

In the normal mode, the driving circuit 36 latches the display data DAT in a horizontal cycle unit, and outputs the source signal Sout2 for displaying a screen having a change in the pattern like a moving image as latched horizontal data is updated in each horizontal cycle. In the normal mode, the clock CLK is used for control of a latch and the output of the source signal S out. For reference, the clock CLK is not illustrated in FIG. 4, for convenience of description.

When the driver 30 enters the low power mode, the driving circuit 36 latches first horizontal data in a first horizontal cycle and second horizontal data in a second horizontal cycle that is faster than the first horizontal cycle by one cycle. In this case, the first horizontal data in the first horizontal cycle may be understood as corresponding to horizontal data included in the horizontal data period 2H of FIG. 3. The second horizontal data in the second horizontal cycle may be understood as corresponding to horizontal data included in the horizontal data period 1H of FIG. 3.

Furthermore, the driving circuit 36 outputs the source signal Sout2 for displaying a screen, in which the same pattern is repeated in a horizontal cycle unit like a still image, using the latched first horizontal data and second horizontal data.

The driving circuit 36 may be described with reference to FIG. 4.

The driving circuit 36 includes a shift register SR, a first latch circuit LAT1, a second latch circuit LAT2, a first selection circuit MUX1, a second selection circuit MUX2, a digital analog converter (DAC), and a buffer circuit BUF.

The shift register SR aligns display data DAT, received in series, into horizontal data in a horizontal cycle unit, and provides the pixel data of the horizontal data to the first latch circuit LAT1 in parallel.

The first latch circuit LAT1 includes first latches LAT11, LAT12, and LAT13 for storing first pixel data.

Furthermore, the second latch circuit LAT2 includes second latches LAT21, LAT22, and LAT23 corresponding to the first latches LAT11, LAT12, and LAT13, respectively, and storing second pixel data. In this case, the second pixel data is updated through the first latches LAT11, LAT12, and LAT13.

More specifically, the second pixel data is obtained by updating the first pixel data stored in the first latches LAT11, LAT12, and LAT13 in a second horizontal cycle, before the first latches LAT11, LAT12, and LAT13 are updated with the first pixel data in a first horizontal cycle.

Each of the first latch circuit LAT1 and the second latch circuit LAT2 updates and latches data, stored in each horizontal cycle, in the normal mode.

In contrast, in the low power mode, the first latch circuit LAT1 updates first horizontal data in a first horizontal cycle and maintains the first horizontal data during the low power mode. The second latch circuit LAT2 updates second horizontal data in a second horizontal cycle and maintains the second horizontal data during the low power mode.

The first selection circuit MUX1 includes first selection units MUX11, MUX12, and MUX13 each configured with a multiplexer. Each of the first selection units MUX11, MUX12, and MUX13 is configured to select one of first pixel data and second pixel data and to output the selection data. The first selection circuit MUX1 is configured to receive the first selection signal SEL1 from the timing controller 10 in the low power mode and to perform selection and output in response to the selection signal SEL1.

More specifically, the first selection unit MUX11 is configured to select one of the first pixel data of the first latch LAT11 and the second pixel data of the second latch LAT21 in response to the selection signal SEL1 and to output the selection data. The first selection unit MUX12 is configured to select one of the first pixel data of the first latch LAT12 and the second pixel data of the second latch LAT22 in response to the selection signal SEL1 and to output the selected data. The first selection unit MUX13 is configured to select one of the first pixel data of the first latch LAT13 and the second pixel data of the second latch LAT23 in response to the selection signal SEL1 and to output the selection data.

The second selection circuit MUX2 includes second selection units MUX21, MUX22, and MUX23 each configured with a multiplexer. Each of the second selection units MUX21, MUX22, and MUX23 is configured to select one of the selection data of a pair of adjacent first selection units and to output source data. The second selection circuit MUX2 is configured to receive the second selection signal SEL2 from the timing controller 10 in the low power mode and to perform selection and output in response to the selection signal SEL2.

Figure 4:
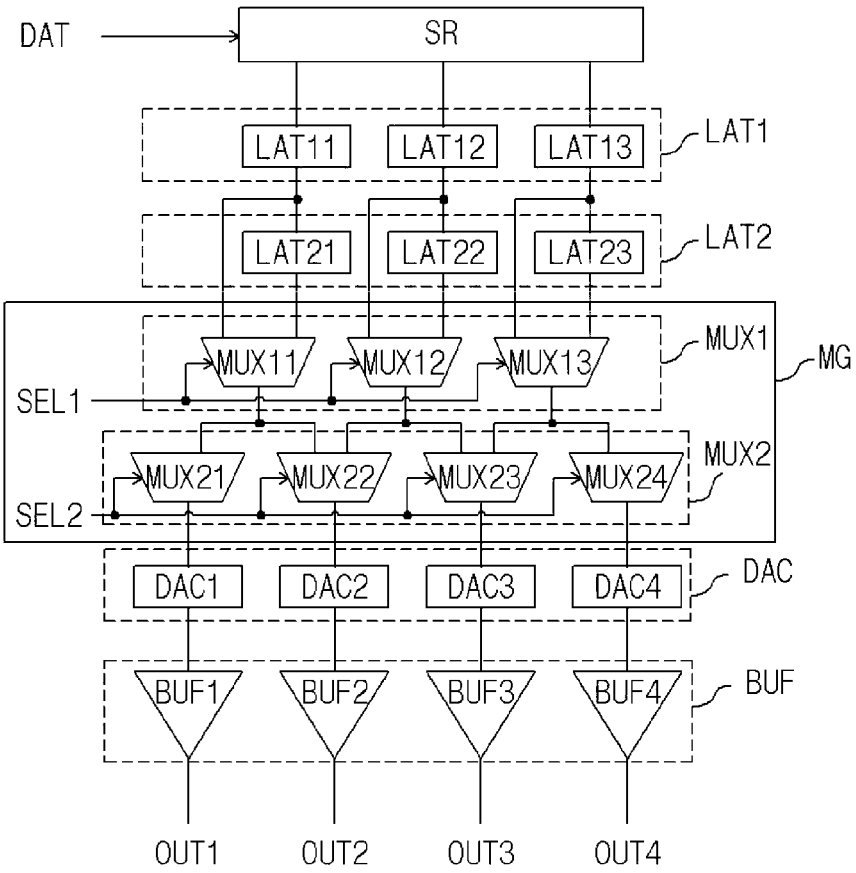
FIG. 4 is a block diagram illustrating a driving apparatus for a display according an embodiment of the present disclosure.

In FIG. 4, the second selection unit MUX21 has one floated input stage. The input stage may be understood as having a first selection unit virtually connected thereto.

Accordingly, the second selection unit MUX21 is configured to select one of the selection data of an adjacent virtual first selection unit and the first selection unit MUX11 in response to the selection signal SEL2 and to output source data. The second selection unit MUX22 is configured to select one of the selection data of the adjacent first selection units MUX11 and MUX12 in response to the selection signal SEL2 and to output source data. The second selection unit MUX23 is configured to select one of the selection data of the adjacent first selection units MUX12 and MUX13 in response to the selection signal SEL2 and to output source data.

The digital analog converter DAC includes digital analog converters DAC1, DAC2, and DAC3 corresponding to the second selection units MUX21, MUX22, and MUX23 of the second selection circuit MUX2, respectively. Each of the digital analog converters DAC1, DAC2, and DAC3 is configured to output an analog signal corresponding to input source data.

The buffer circuit BUF includes buffers BUF1, BUF2, and BUF3 corresponding to the digital analog converters DAC1, DAC2, and DAC3 of the digital analog converter DAC, respectively. The buffers BUF1, BUF2, and BUF3 output source signals OUT1 to OUT3 corresponding to the input analog signals, respectively.

In the driver 30, when recognizing entry into the low power mode based on the low power information, the CDR circuit 32 restores horizontal data, including the low power information in a horizontal cycle, and a clock, enters the low power mode, and then stops the restoration of the display data DAT and the clock CLK.

In accordance with the operation of the CDR circuit 32, the driving circuit 36 receives first horizontal data in a first horizontal cycle and second horizontal data in a second horizontal cycle at timing at which the driver 30 enters the low power mode.

In the low power mode, the first latch circuit LAT1 maintains the first horizontal data in the first horizontal cycle, and the second latch circuit LAT2 maintains the second horizontal data, updated through the first latch circuit LAT1, in the second horizontal cycle.

In the low power mode, the first horizontal data of the first latch circuit LAT1 and the second horizontal data of the second latch circuit LAT2 are rendered in the display panel 50 using the DRD method according to an embodiment of the present disclosure. The rendering of the first horizontal data and the second horizontal data is controlled by the switching of the first selection circuit MUX1 and the second selection circuit MUX2.

Illustratively, the first selection unit MUX11 of the first selection circuit MUX1 selects one of the first latch LAT11 for storing the first pixel data of the first horizontal data and the second latch LAT21 for storing the second pixel data of the second horizontal data, and outputs the selected pixel data as selection data.

As described above, each of the first selection units MUX11, MUX12, and MUX13 of the first selection circuit MUX1 is configured to select one of a first latch of the first latch circuit LAT1, connected thereto, and a second latch of the second latch circuit LAT2, connected thereto, and to output selected pixel data as selection data.

As a result, the first selection circuit MUX1 has a function for selecting pixel data for rendering among the first horizontal data in the first horizontal cycle and the second horizontal data in the second horizontal cycle. The selection of the pixel data for rendering may be determined based on a level of the first selection signal SEL1.

Furthermore, illustratively, the second selection unit MUX22 of the second selection circuit MUX2 is configured to select one of the selection data of the adjacent first selection units MUX11 and MUX12 and to output the selected selection data as source data.

The first selection circuit MUX1 and the second selection circuit MUX2 may be understood as being configured so that the selection data of each of the first selection units MUX11, MUX12, and MUX13 of the first selection circuit MUX1 is output as source data through one of the adjacent second selection units of the second selection circuit MUX2.

That is, the second selection circuit MUX2 has a function for selecting a channel for rendering the first horizontal data or the second horizontal data. The selection of the channel for rendering may be determined based on a level of the second selection signal SEL2.

The embodiment of FIG. 4 may be applied to a DRD structure in which two horizontal data are rendered in two pairs of pixels, respectively, which share one data line and are disposed right and left.

Figure 5:
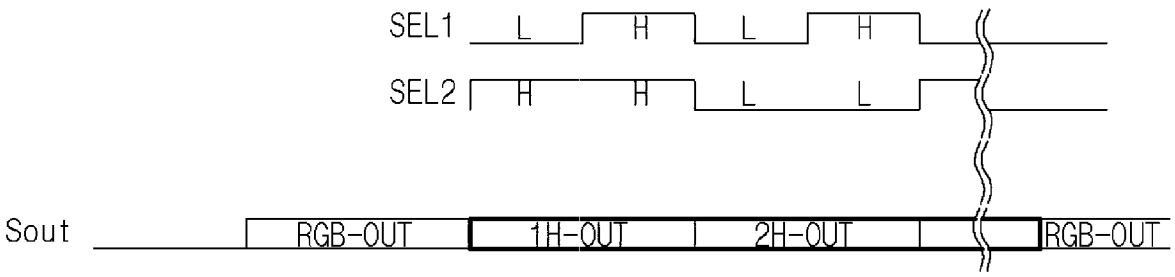
FIG. 5 is a waveform diagram describing an operation of the driving apparatus according to the embodiment of FIG. 4.

To this end, the first selection signal SEL1 and the second selection signal SEL2 may be illustrated as in FIG. 5 in the low power mode. In FIG. 5, Sout illustrates the output of a source signal.

In FIG. 5, the states of the first selection signal SEL1 and the second selection signal SEL2 are changed into a first state (low level (L), high level (H)), a second state (H, H), a third state (L, L), and a fourth state (H, L) in predetermined order.

The first selection circuit MUX1 and the second selection circuit MUX2 align two first pixel data, included in first horizontal data in continuous order, and two second pixel data, included in second horizontal data in continuous order, so that the first and second pixel data are sequentially output as source data for the same data line, in response to the first selection signal SEL1 and the second selection signal SEL2.

Figures 6, 7, 8:
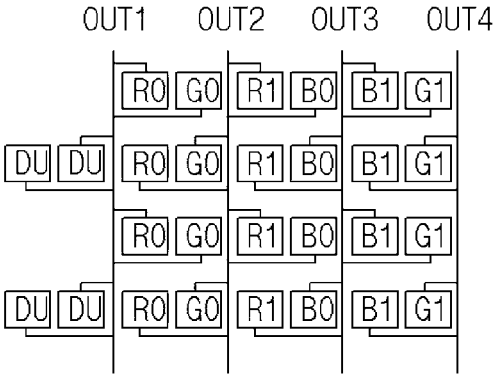
FIG. 6 is a table illustrating first horizontal data and second horizontal data latched by the operation of FIG. 5.
FIG. 7 is a table illustrating a first selection signal, a second selection signal, and data updated into digital analog converters (DACs) for the operation of FIG. 5.
FIG. 8 is a diagram illustrating the results of rendering by the operation of FIG. 5.

Reference is made to FIGS. 6 to 8 in order to describe rendering by the first selection signal SEL1 and the second selection signal SEL2 of FIG. 5. FIG. 6 is a table illustrating first horizontal data LAT1_D latched in the latches of the first latch circuit LAT1 and second horizontal data LAT2_D latched in the latches of the second latch circuit LAT2 in the low power mode in FIG. 5. FIG. 7 is a table illustrating the first selection signal, the second selection signal, and data updated into the DACs for the operation of FIG. 5. FIG. 8 is a diagram illustrating the results of the rendering by the operation of FIG. 5.

In the low power mode, the first latch circuit LAT1 and the second latch circuit LAT2 latch the first horizontal data LAT1_D and the second horizontal data LAT2_D, as illustrated in FIG. 6. FIG. 6 illustrates a table corresponding to six channels, but the structures of the first latch circuit LAT1 and the second latch circuit LAT2 for the channels may be understood with reference to FIG. 4.

When the first selection signal SEL1 and the second selection signal SEL2 are provided to the first selection circuit MUX1 and the second selection circuit MUX2, respectively, in the first state (L, H), as illustrated in FIG. 7, source data updated into the digital analog converters DACs of the digital analog converter DAC are aligned identically with the second horizontal data LAT2_D stored in the second latch circuit LAT2 of FIG. 6.

Thereafter, when the first selection signal SEL1 and the second selection signal SEL2 are provided to the first selection circuit MUX1 and the second selection circuit MUX2, respectively, in the second state (H, H), as illustrated in FIG. 7, source data updated into the digital analog converters DACs of the digital analog converter DAC are aligned identically with the first horizontal data LAT1_D stored in the first latch circuit LAT1 of FIG. 6.

The source data updated into the digital analog converters DACs of the digital analog converter DAC in accordance with changes in the first selection signal SEL1 and the second selection signal SEL2 having the first state (L, H) and the second state (H, H), respectively, may show that Sout corresponds to a source signal 1H-OUT in FIG. 5.

Thereafter, when the first selection signal SEL1 and the second selection signal SEL2 are provided to the first selection circuit MUX1 and the second selection circuit MUX2 in the third state (L, L), as illustrated in FIG. 7, source data updated into the digital analog converters DACs of the digital analog converter DAC are aligned in the state in which the second horizontal data LAT2_D stored in the second latch circuit LAT2 of FIG. 6 has been shifted to the left.

Thereafter, when the first selection signal SEL1 and the second selection signal SEL2 are provided to the first selection circuit MUX1 and the second selection circuit MUX2 in the fourth state (H, L), as illustrated in FIG. 7, source data updated into the digital analog converters DACs of the digital analog converter DAC are aligned in the state in which the first horizontal data LAT1_D stored in the first latch circuit LAT1 of FIG. 6 has been shifted to the left.

The source data updated into the digital analog converters DACs of the digital analog converter DAC in accordance with changes in the first selection signal SEL1 and the second selection signal SEL2 having the third state (L, L) and the fourth state (H, L) may show that Sout corresponds to a source signal 2H-OUT in FIG. 5.

When the first horizontal data LAT1_D and the second horizontal data LAT2_D are aligned in the digital analog converters DACs of the digital analog converter DAC in accordance with changes in the first selection signal SEL1 and the second selection signal SEL2, respectively, the rendering of pixel data of the display panel 50 may be implemented as in FIG. 8.

FIG. 8 is a diagram illustrating that pixel data has been rendered in the display panel 50 having a DRD structure in which two horizontal data are rendered in two pairs of pixels, respectively, which share one data line and are disposed right and left.

Furthermore, the embodiment of FIG. 4 may be applied to a DRD structure in which two horizontal data are rendered in two pixels, respectively, which share one data line and are disposed right and left.

Figure 9:
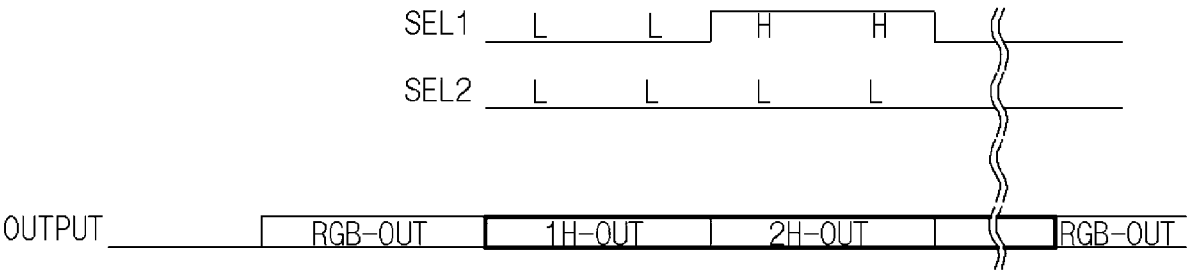
FIG. 9 is a waveform diagram describing another operation of the driving apparatus according to the embodiment of FIG. 4.

To this end, the first selection signal SEL1 and the second selection signal SEL2 may be illustrated as in FIG. 9 in the low power mode. In FIG. 9, Sout illustrates the output of the source signal.

In FIG. 9, the first selection signal SEL1 is provided so that a high level (H) and a low level (L) vary. The second selection signal SEL2 maintains a fixed level (e.g., a low level (L)).

The first selection circuit MUX1 and the second selection circuit MUX2 align the first pixel data and the second pixel data in response to the first selection signal SEL1 and the second selection signal SEL2, respectively, so that the first pixel data and the second pixel data are alternately output as source data for the same data line.

Figures 10, 11, 12:
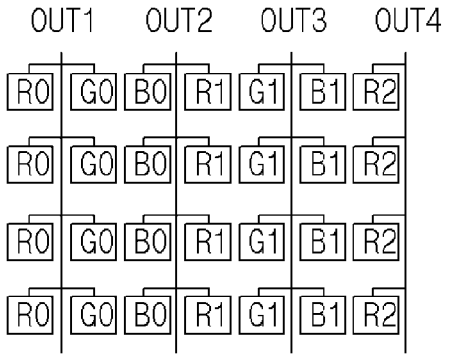
FIG. 10 is a table illustrating first horizontal data and second horizontal data latched by the operation of FIG. 9.
FIG. 11 is a table illustrating a first selection signal, a second selection signal, and data updated into the digital analog converters for the operation of FIG. 9.
FIG. 12 is a diagram illustrating the results of rendering by the operation of FIG. 9.

Reference is made to FIGS. 10 to 12 in order to describe the rendering by the first selection signal SEL1 and the second selection signal SEL2 in FIG. 9. FIG. 10 is a table illustrating the first horizontal data LAT1_D, latched in the latches of the first latch circuit LAT1, and second horizontal data LAT2_D latched in the latches of the second latch circuit LAT2 in the low power mode in FIG. 9. FIG. 11 is a table illustrating the first selection signal, the second selection signal, and data updated into the DACs for the operation of FIG. 9. FIG. 12 is a diagram illustrating the results of the rendering by the operation of FIG. 9.

In the low power mode, the first latch circuit LAT1 and the second latch circuit LAT2 latch the first horizontal data LAT1_D and the second horizontal data LAT2_D, respectively, as illustrated in FIG. 10. FIG. 10 also illustrates a table corresponding to six channels, but the structures of the first latch circuit LAT1 and the second latch circuit LAT2 for the six channels may be understood with reference to FIG. 4.

In the case of FIG. 9, the second selection signal SEL2 maintains the fixed level (L), and the first selection signal SEL1 shifts to a high level (H) and a low level (L). Accordingly, the first selection circuit MUX1 outputs the second horizontal data LAT2_D as selection data when the first selection signal SEL1 has a low level, and outputs the first horizontal data LAT1_D as selection data when the first selection signal SEL1 has a high level. Furthermore, since the second selection circuit MUX2 maintains the fixed level, the connection state of the digital analog converters DACs of the digital analog converter DAC into which the source data will be updated is fixed.

Accordingly, the first selection circuit MUX1 and the second selection circuit MUX2 may align the first pixel data of the first horizontal data LAT1_D and the second pixel data of the second horizontal data LAT2_D in response to the first selection signal SEL1 and the second selection signal SEL2, respectively, so that the first and second pixel data are alternately output as the source data for the same data line.

When the first horizontal data LAT1_D and the second horizontal data LAT2_D are aligned in the digital analog converters DACs of the digital analog converter DAC as in FIG. 11 in accordance with changes in the first selection signal SEL1 and the second selection signal SEL2, the rendering of the pixel data of the display panel 50 may be implemented as in FIG. 12.

FIG. 12 is a diagram illustrating that pixel data has been rendered in the display panel 50 having a DRD structure in which two horizontal data are rendered in two pixels that share one data line and that are disposed right and left, respectively.

As described above, an embodiment of the present disclosure has a latch structure in which display data is distributed in a time division manner using the DRD method. Accordingly, there is an advantage in that a display panel having a DRD structure can be driven.

Furthermore, according to an embodiment of the present disclosure, when display data is distributed using the DRD method, the update of horizontal data between the latches occurs once. Accordingly, an embodiment of the present disclosure has advantages in that the number of updates of horizontal data can be minimized, which makes it possible to reduce the occurrence of EMI and to implement a latch structure with a small number of parts.

Furthermore, an embodiment of the present disclosure has advantages in that the low power mode can be performed in which horizontal data latched in accordance with the repeated same pattern like a still image is repeatedly used, which makes it possible to reduce power consumption of the driving apparatus necessary for a display.

Furthermore, an embodiment of the present disclosure has advantages in that display data can be distributed in a time division manner in accordance with the DRD structure in which one data line is shared by two pixels on the left and two pixels on the right or the DRD structure in which one data line is shared by a pair of left and right pixels and the low power mode for the DRD structures can be provided.

Furthermore, an embodiment of the present disclosure has an advantage in that the driving apparatus having a latch structure for distributing display data in a time division manner using the DRD method can reduce power consumption by performing the low power mode, and outputting, in the low power mode, a source signal using latched horizontal data without the restoration of display data and a clock and bypassing a lock signal.

The driving apparatus for a display according to the present disclosure has a latch structure for distributing display data in a time division manner using the DRD method and thus can drive a display panel having a DRD structure.

Furthermore, the driving apparatus for a display according to the present disclosure has advantages in that the number of updates of horizontal data can be minimized when display data is latched using the DRD method according to an embodiment of the present disclosure, which makes it possible to reduce the occurrence of EMI and to implement a latch structure with a small number of parts.

Furthermore, the driving apparatus for a display according to the present disclosure has an advantage in that it can reduce power consumption by performing the low power mode in accordance with the repeated same pattern like a still image and distributing display data according to the DRD method using latched horizontal data in the low power mode.

Furthermore, the driving apparatus for a display according to the present disclosure has an advantage in that it can provide the low power mode in accordance with the DRD structure in which one data line is shared by two pixels on the left and two pixels on the right or the DRD structure in which one data line is shared by a pair of left and right pixels.

Furthermore, the driving apparatus according to the present disclosure has an advantage in that it can reduce power consumption by performing the low power mode, outputting a source signal using latched horizontal data without the restoration of display data and a clock in the low power mode, and bypassing a lock signal.

What is claimed is:

1. A driving apparatus for a display, comprising:

a first latch circuit comprising first latches storing first pixel data;

a second latch circuit comprising second latches corresponding to the first latches, respectively, and storing second pixel data, wherein the second pixel data is updated through the first latch corresponding to the second latch;

a first selection circuit comprising first selection units each selecting one of the first pixel data and the second pixel data and outputting the selection data; and a second selection circuit comprising second selection units each selecting one of the selection data of a pair of adjacent first selection units and outputting source data.

2. The driving apparatus of claim 1, wherein:

the first pixel data is included in first horizontal data in a first horizontal cycle;

the second pixel data is included in second horizontal data in a second horizontal cycle faster than the first horizontal cycle by one cycle; and the second pixel data is updated into the first latch in the second horizontal cycle before the first pixel data is updated into the first latch in the first horizontal cycle.

3. The driving apparatus of claim 2, wherein:

a low power mode is set based on first low power information in the first horizontal cycle and second low power information in the second horizontal cycle, and in the low power mode, the first latch circuit stores the first horizontal data as the first pixel data and then stops an update, and the second latch circuit stores the second horizontal data as the second pixel data and then stops an update.

4. The driving apparatus of claim 3, wherein:

the first latch circuit and the second latch circuit resume the updates of the first pixel data and the second pixel data in response to a mode control signal notifying timing at which the low power mode is terminated, after wake-up timing, and the mode control signal is provided from an outside separately from a data packet comprising the first horizontal data and the second horizontal data.

5. The driving apparatus of claim 3, wherein:

when the first low power information in the first horizontal cycle has a value for enabling, the first latch circuit stores the first horizontal data as the first pixel data and then stops an update, and when the second low power information in the second horizontal cycle has a value for enabling, the second latch circuit stores the second horizontal data as the second pixel data and then stops an update.

6. The driving apparatus of claim 5, wherein:

a first selection signal and a second selection signal are received from an outside in the low power mode separately from a data packet comprising the first horizontal data and the second horizontal data, the first selection unit of the first selection circuit selects the first pixel data or the second pixel data in response to the first selection signal, and the second selection unit of the second selection circuit selects one of the selection data of the pair of adjacent first selection units in response to the second selection signal.

7. The driving apparatus of claim 6, wherein:

states of the first selection signal and the second selection signal are changed into a first state (low level, high level), a second state (high level, high level), a third state (low level, low level), and a fourth state (high level, low level) in predetermined order, and in response to the first selection signal and the second selection signal, the first selection circuit and the second selection circuit align two first pixel data, included in the first horizontal data in continuous order, and two second pixel data, included in the second horizontal data in continuous order, respectively, so that the two first pixel data and the two second pixel data are sequentially output as source data for an identical data line.

8. The driving apparatus of claim 6, wherein:

the first selection signal is provided to shift to a high level and a low level, the second selection signal is provided in a fixed level, and in response to the first selection signal and the second selection signal, the first selection circuit and the second selection circuit align the first pixel data and the second pixel data, respectively, so that the first and second pixel data are alternately output as the source data for an identical data line.

9. A driving apparatus for a display, comprising:

a first latch storing first pixel data in a first horizontal cycle;

a second latch storing second pixel data in a second horizontal cycle faster than the first horizontal cycle by one cycle, wherein the second pixel data is updated into the second latch through the first latch;

a first selection unit selecting one of the first pixel data and the second pixel data and outputting first selection data;

a third latch storing third pixel data in the first horizontal cycle;

a fourth latch storing fourth pixel data in the second horizontal cycle, wherein the fourth pixel data is updated into the fourth latch through the third latch;

a second selection unit selecting one of the third pixel data and the fourth pixel data and outputting second selection data; and a third selection unit selecting the first selection data or the second selection data and outputting source data.

10. The driving apparatus of claim 9, wherein:

a low power mode is set based on first low power information in the first horizontal cycle and second low power information in the second horizontal cycle, when the first low power information has a value for enabling the low power mode, the first latch and the third latch store the first pixel data and the third pixel data in the first horizontal cycle and then stop the updates, and when the second low power information has a value for enabling the low power mode, the second latch and the fourth latch store the second pixel data and the fourth pixel data in the second horizontal cycle and then stop the updates.

11. The driving apparatus of claim 10, wherein:

the first latch to the fourth latch resume the updates of the first pixel data to the fourth pixel data in response to a mode control signal notifying timing at which the low power mode is terminated, after wake-up timing, and the mode control signal is provided from an outside separately from a data packet comprising the first pixel data to the fourth pixel data.

12. The driving apparatus of claim 10, wherein:

when the first low power information in the first horizontal cycle has a value for the enabling, the first latch and the third latch store first horizontal data as the first pixel data and then stop updates, and when the second low power information in the second horizontal cycle has a value for the enabling, the second latch and the fourth latch store second horizontal data as the second pixel data and then stop updates.

13. The driving apparatus of claim 10, wherein:

a first selection signal and a second selection signal are received from an outside in the low power mode separately from a data packet comprising first horizontal data and second horizontal data, the selection and output of the first selection unit and the second selection unit are controlled by the first selection signal, and the selection and output of the third selection unit are controlled by the second selection signal.

14. The driving apparatus of claim 13, wherein:

states of the first selection signal and the second selection signal are changed into a first state (low level, high level), a second state (high level, high level), a third state (low level, low level), and a fourth state (high level, low level) in predetermined order, and in response to the first selection signal and the second selection signal, the first selection unit to the third selection unit align the first pixel data to the fourth pixel data so that the first pixel data to the fourth pixel data are sequentially output as the source data for an identical data line.

15. The driving apparatus of claim 13, wherein:

the first selection signal is provided to shift to a high level and a low level, the second selection signal is provided in a fixed level, and in response to the first selection signal and the second selection signal, the first selection unit to the third selection unit align the first pixel data and the third pixel data or the second pixel data and the fourth pixel data so that the first and third pixel data or the second and fourth pixel data are alternately output as the source data for an identical data line.

* * * * *